United States Patent [19]

Montgomery et al.

[11] 4,191,364

[45] Mar. 4, 1980

[54] SUPPORT FOR METALLURGICAL VESSELS

[75] Inventors: Harry T. Montgomery, New Castle; Rashed N. Nagati, Mars, both of Pa.

[73] Assignee: Pennsylvania Engineering Corporation, Pittsburgh, Pa.

[21] Appl. No.: 898,293

[22] Filed: Apr. 20, 1978

[51] Int. Cl.[2] ..... C21C 5/50

[52] U.S. Cl. ..... 266/246

[58] Field of Search ..... 266/243-246

[56] References Cited

U.S. PATENT DOCUMENTS

| | | | |
|---|---|---|---|
| 3,561,744 | 2/1971 | Altman et al. | 266/246 |
| 3,652,072 | 3/1972 | Stresemann et al. | 266/246 |
| 3,653,648 | 4/1972 | Mevissen et al. | 266/246 |
| 3,799,527 | 3/1974 | Fisher | 266/246 |

*Primary Examiner*—Paul A. Bell

[57] ABSTRACT

A metallurgical vessel includes a plurality of brackets which engage the upper surface of a trunnion ring for support. A gib assembly is mounted adjacent the lateral sides of each bracket. Each gib assembly includes a first member secured to the trunnion ring and a second member removably and slidably mounted on the first member for movement into and out of the clamping engagement with the side of its associated bracket. The vessel may also include a second plurality of brackets engaging the lower surface of the trunnion ring and shim blocks mounted on the trunnion ring and adjacent the lateral side of each bottom bracket for movement into wedging engagement therewith.

13 Claims, 18 Drawing Figures

SUPPORT FOR METALLURGICAL VESSELS

BACKGROUND OF THE INVENTION

This invention relates to means for mounting a metallurgical vessel on a supporting trunnion ring.

Metallurgical converters such as BOF vessels, Q-BOP vessels and AOD vessels generally comprise a pear-shaped vessel which is mounted on a trunnion ring for being pivoted about a horizontal axis. Such vessels normally include a plurality of flanges affixed to their outer surfaces and adapted to engage the supporting trunnion ring. The brackets are normally releasably secured to the trunnion ring by means of a pair of gibs affixed to the trunnion ring adjacent the lateral edges of the support bracket. A plurality of shims are also normally provided for being wedged between the gibs and their associated brackets for providing a rigid connection therebetween. One such prior art assembly is described in U.S. Pat. No. 3,561,744.

While these prior art vessel mounting assemblies have provided satisfactory means for securing a metallurgical vessel to a trunnion ring, it has been difficult to repair or replace the gibs which may tend to wear during normal operation.

SUMMARY OF THE INVENTION

It is an object of the invention to provide a new and improved means for securing a metallurgical vessel to a trunnion ring.

Another object of the invention is to provide a metallurgical vessel mounting assembly in which parts subject to wear may be removed for repair and replacement.

These and other objects and advantages of the present invention will become more apparent from the detailed description thereof taken with the accompanying drawings.

DETAILED DESCRIPTION OF THE PREFERRED EMBODIMENT

Figure 1:
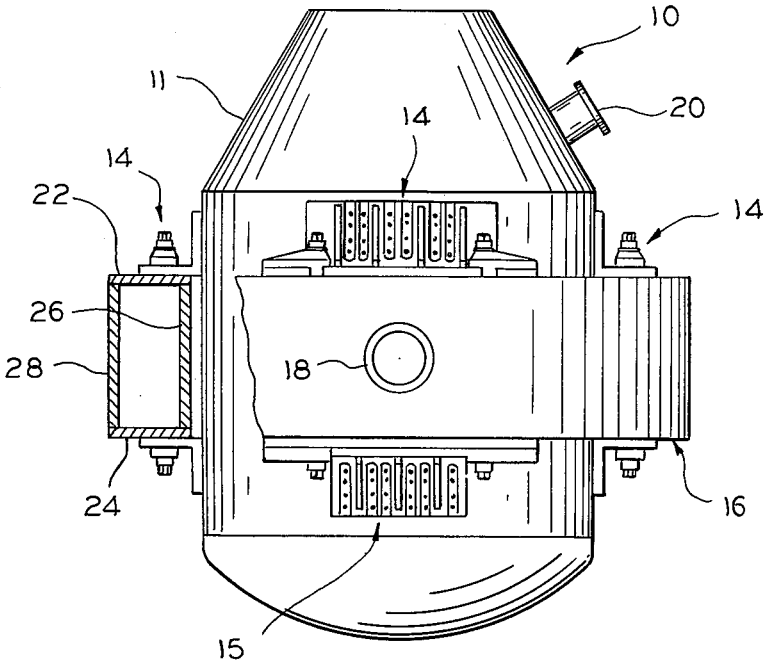
FIG. 1 is a side elevational view of a converter vessel with which the suspension assembly of the present invention is usable.

The invention will be illustrated in connection with a vessel 10, shown in FIGS. 1 and 2 to be generally pear shaped and open at its upper end. Vessel 10 includes a metallic shell 11 and a refractory lining 12. A plurality of upper and lower support assemblies 14 and 15 secure vessel 10 to a trunnion ring 16. A trunnion 18 extends from each of the opposite sides of trunnion ring 16 and each is supported in a well known manner on bearing structures (not shown). One of the trunnions 18 is also coupled to a suitable drive mechanism (not shown) for tilting the vessel 10 to various positions to permit charging, de-slagging, sampling, temperature measurement, or discharge of hot metal through a pouring spout 20.

Figure 2:
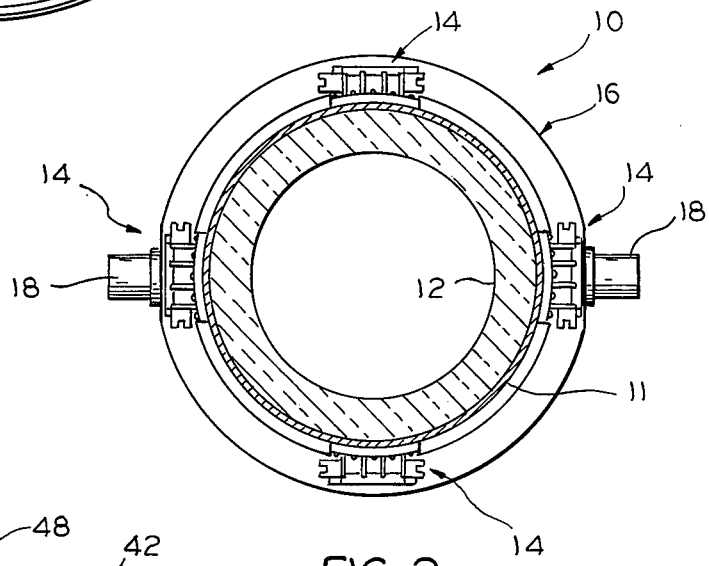
FIG. 2 is a top plan view, partly in section, of the vessel illustrated in FIG. 1.

While the preferred embodiment of the invention is shown in FIGS. 1 and 2 to include four upper suspension assemblies 14 and two lower assemblies 15, the actual number of each will be governed by the size and weight of the vessel 10 being supported. Preferably the upper and lower assemblies are spaced equiangularly around the vessel, which in the case of four assemblies, the displacement would be at a radial angle of substantially 90°.

The trunnion ring 16 is comprised of upper and lower flanges 22 and 24 and inner and outer wrappers 26 and 28 which are joined to form the generally hollow, annular assembly through which cooling water may be circulated in a manner well known in the art.

Figure 5:
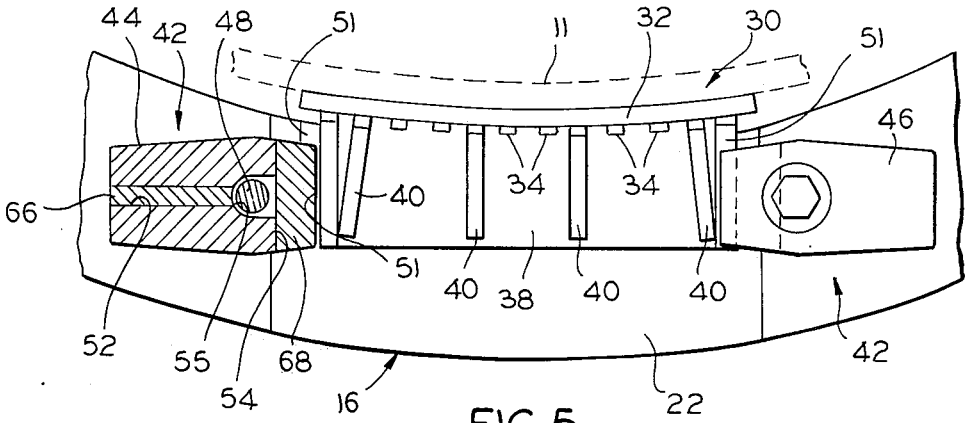
FIG. 5 is a top plan view, partly in section, of the embodiment of FIG. 3.
Figure 4:
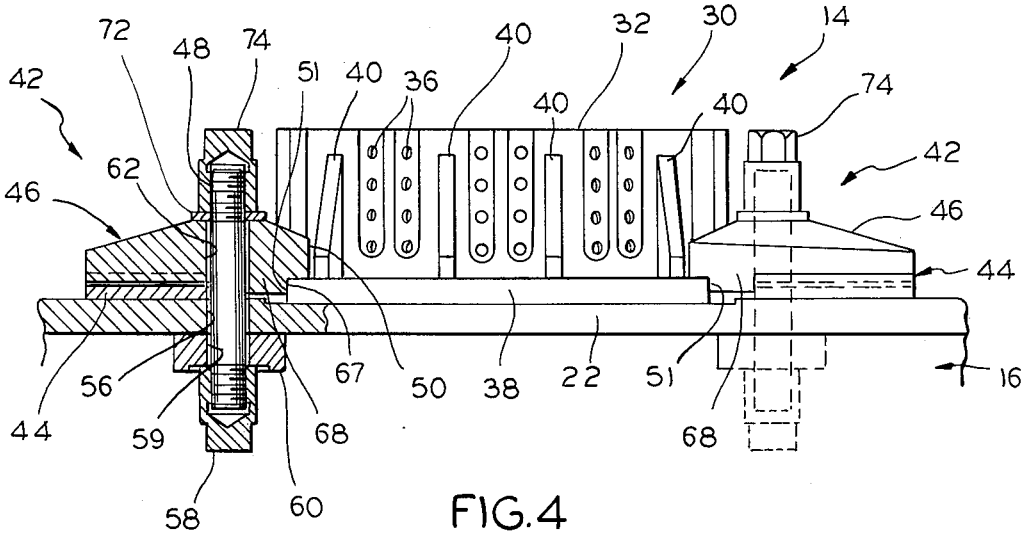
FIG. 4 is a side elevational view, partly in section of the embodiment of FIG. 3.
Figure 6:
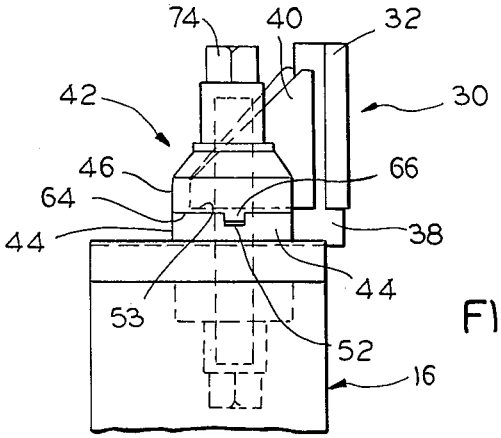
FIG. 6 is an end view of the embodiment of FIG. 3.

As seen in FIGS. 4–6, the upper suspension assembly 14 includes a bracket assembly 30 suitably affixed to the shell 11 and engaging the upper surface of the trunnion ring top flange 22. More specifically, the bracket assembly 30 includes a curved mounting plate 32 whose inner surface conforms generally to that of the shell 11 and to which it is secured by means of a plurality of bolts or rivets 34 extending through openings 36 formed in plate 32. Affixed to the lower end of mounting plate 32 is a bracket plate 38 which is generally flat and engages the upper surface of trunnion ring flange 22. A plurality of generally triangular strengthening ribs 40 are affixed to the plates 32 and 38.

Figure 3:
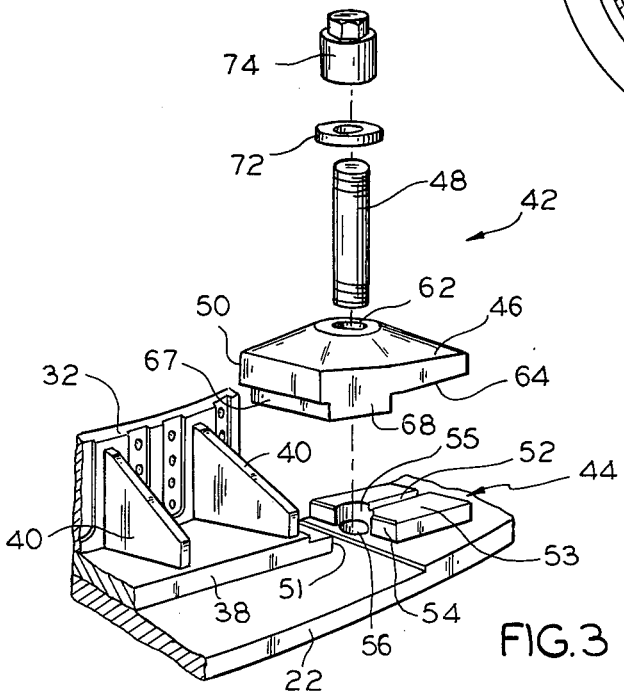
FIG. 3 is an exploded perspective view of the suspension assembly according to the preferred embodiment of the invention.

A pair of gib assemblies 42 are mounted on the upper trunnion ring flange 22 and adjacent the lateral edges of the mounting plate 38 for mounting the same to flange 22. The gib assembly 42 is shown in FIGS. 3 to 5 to include a shear block 44 affixed to the upper surface of the flange 22, a gib block 46 removably mounted on shear block 44 by means of pin 48. A nose portion 50 of gib block 46 engages the lateral edge of bracket plate 38.

Shear block 44 comprises a generally flat plate which is welded to flange 22 adjacent the expected position of the end 51 of plate 38. A longitudinal slot 52 is formed in the upper surface 53 of block 44 and extends in a direction generally normal to the end 51 of plate 38. At the forward edge 54 of plate 44 a semi-circular recess 55 is formed in general registry with an opening 56 in flange 22 through which the pin 48 extends.

As seen in FIG. 4, the lower end of pin 48 is threaded for being received in a cap nut 58, which is secured to a block 60 welded to the undersurface of flange 22 and having an opening 59 in registry with aperture 56. Pin 48 extends upwardly from cap screw 58 through opening 59 and the aperture 56, and above the upper surface of shear block 44.

The gib block 46 consists of a unitary member which is generally rectangular in plan view and whose top is defined by a plurality of upwardly sloping surfaces so that the block is substantially thicker at its central portion than along its edges. A vertically extending aperture 62 is formed through the center of gib block 46 and at approximately its thickest portion. From approximately the front edge of the aperture 62 to its rear, the gib block is substantially coextensive with the shear block 44 and has a lower, planar surface 64 which engages surfaces 53 of block 44. Extending downwardly from the surface 64 of block 46 and being generally normal to the axis of aperture 62 is a tongue 66 which is received within the groove 52 formed in surface 53. A notch 67 is formed in the front edge of the gib block 46 to define a downwardly projecting wedge portion 68 which extends generally normal to the tongue 66 and which is substantially equal in width to the distance between the forward edge 54 of sheer block 44 and the adjacent edge 51 of bracket plate 38.

When the gib block 46 is to be mounted, it is placed over the upwardly extending pin 48 and with the tongue 66 in the groove 52 and the wedge block 68 in the gap between the edges 55 and 57 of the sheer block 44 and the bracket plates 38 respectively. The gib 46 is retained in position by means of a washer 72 and a cap screw 74 which is received on the threaded upper end of pin 48. When secured in the position shown in FIGS. 4, 5 and 6, the surfaces of gib block notch 67 will be adjacent, but spaced a slight distance from the end 51 and top surface of bracket plate 38. As a result, the bracket plate 22 will be substantially contained except for radial movement as the vessel 10 expands and contracts.

If it becomes necessary to replace any of the gibs 46, this may be accomplished merely by removing its associated cap screw nuts 74. It will also be appreciated that from time to time it becomes necessary to remove a vessel 10 from the trunnion ring 16 for repair or relining. In the latter event, another vessel will be placed in position on ring 16 so that the metallurgical operations may continue. Replacement of vessel 10 is accomplished by removing all the gib blocks 46 after which the vessel may be lifted out of position. An alternate vessel may then be lowered onto the trunnion ring 16 and affixed by replacement of the gib blocks 46.

Figure 8:
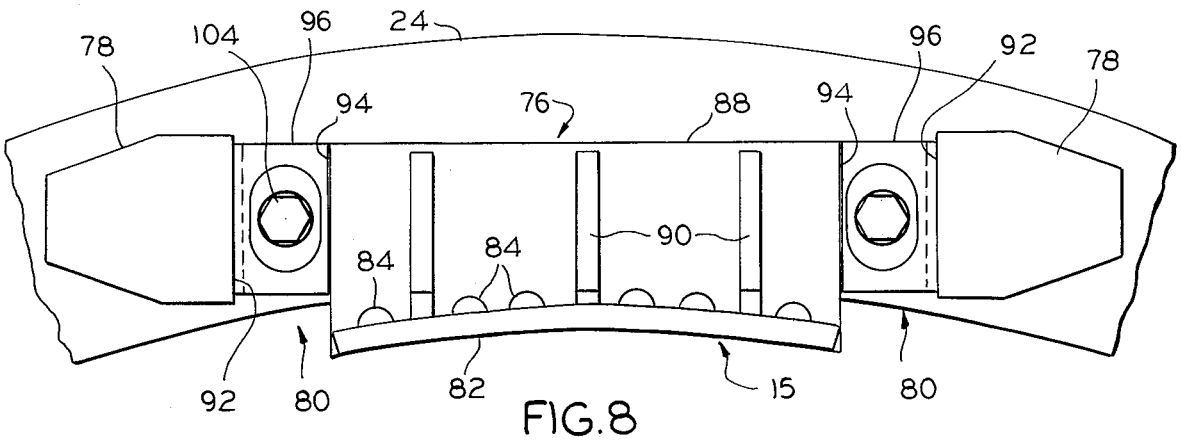
FIG. 8 is a bottom view of the assembly of FIG. 7.
Figure 7:
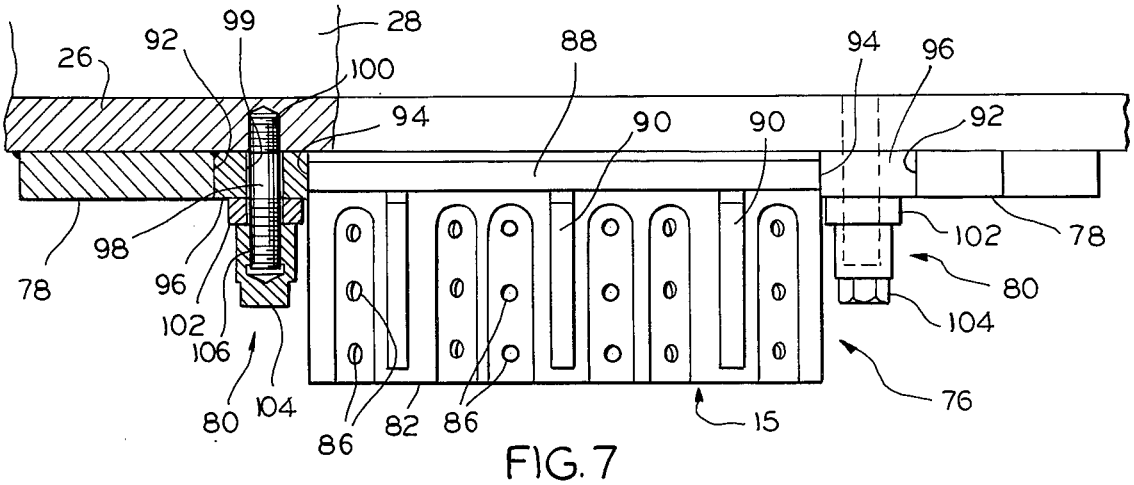
FIG. 7 is a side elevational view, with parts broken away, of a bottom portion of the suspension assembly.

FIGS. 7 and 8 illustrate the bottom bracket assembly 15 in accordance with a preferred embodiment of the invention. Specifically, the bottom clamp assembly 15 includes a bracket 76 affixed to the vessel 10, a stop block 78 affixed to the trunnion ring bottom flange 27 and a shim block assembly 80 constructed and arranged to be wedged between the bracket assembly 76 and the stop block 78.

The bracket 76 is similar to the bracket 30 and includes a curved mounting plate 82 adapted to be affixed to the shell 11 of the vessel by bolts or rivets 84 which extend through openings 86. In addition, a bracket plate 88 is affixed in a normal relation to the mounting plate 82 and the plurality of generally triangular ribs 90 are affixed to plates 82 and 88 for strengthening the same. In order to permit vessel expansion and contraction, the bracket assembly 76 is spaced vertically from bracket assemblies 30 a distance greater than the height of the trunnion ring 16 so that a slight gap exists between plate 88 and the trunnion ring bottom flange 24 as seen in FIG. 7.

The stop blocks 78 are affixed to the trunnion ring bottom flange 24 in spaced relation from and adjacent to the opposite ends of bracket plate 88. A surface 92 is formed on the sides of the stop blocks 78 in an opposed and generally parallel relation to the end surfaces 94 of bracket plate 88.

The shim block assembly 80 includes a rectangular shim block 96 mounted between the surfaces 92 and 94 by means of a pin 98 which extends through an oversized opening 99 formed in block 96 and is received in a threaded hole 100 in bottom flange 24. Shim block 96 is retained in position by means of a washer 102 and a cap nut 104 which is received on the threaded end 106 of pin 98. The width of shim blocks 96 are slightly less than the distance between the surfaces 92 and 94 so as to permit slight relative movement between bracket plate 89 and stop blocks 78 as the vessel shell expands and contracts during vessel operation.

Figure 9:
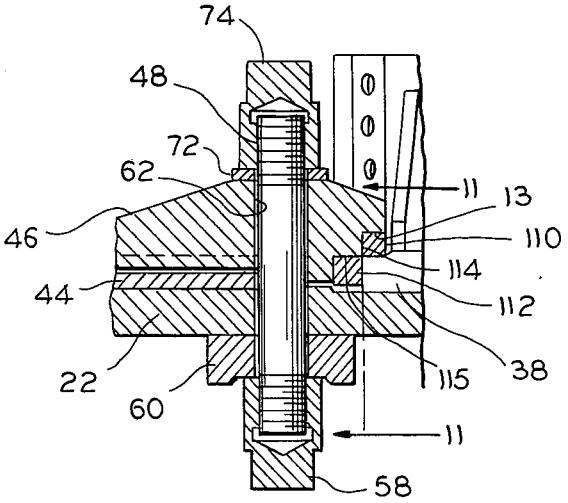
FIG. 9 is a side view, partly in section, of an alternate embodiment of the invention.
Figure 10:
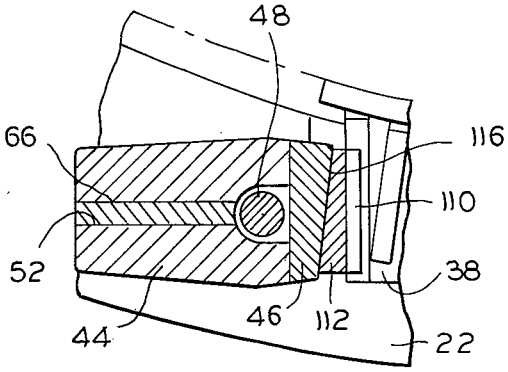
FIG. 10 is a top sectional view of the embodiment of FIG. 9.
Figure 11:
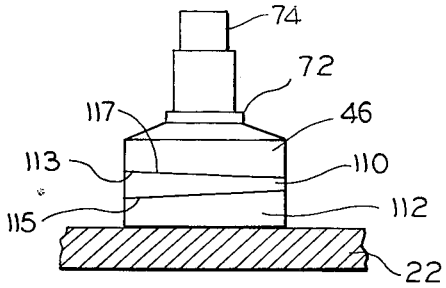
FIG. 11 is a view taken along lines 11—11 of FIG. 9.

FIGS. 9–11 illustrate an alternate embodiment of the present invention wherein the gib assembly 42 has been modified by the inclusion of tapered shims 110 and 112 between the gib block 46 and the bracket plate 38. In addition, gib block 46 has been modified by the provision of a first tapered groove defined by surfaces 113 and 114 for receiving tapered shim 110 and a second tapered groove defined by surfaces 115 and 116 for receiving tapered shim 12. As seen in FIG. 11, the surface 113 of gib block 46 is inclined downwardly at a slight angle from its outer to its inner end relative to the upper surface of the bracket plate 38 and is spaced therefrom to define a wedge shaped gap. The shim block 110 includes a similarly tapered upper surface 117 so that block 110 corresponds generally to the gap between the gib block surface 113 and flange plate 38. The surface 116 is tapered inwardly from its outer to its inner end as shown in FIG. 10 and wedge block 112 is similarly tapered so that it corresponds generally to the wedge shaped gap between the surface 116 and the edge of bracket plate 38. The shims 110 and 112 may be joined along their untapered edges so that they may be inserted and removed as a unitary member.

In the assembly of the embodiment of FIGS. 9–11, the gib block 46 is a first trial fit in position after which the shims 110 and 114 are welded in the illustrated position such that a slight gap exists between the shims and bracket plate 38. This permits movement of bracket plate 38 relative to gib assembly 42.

Figure 12:
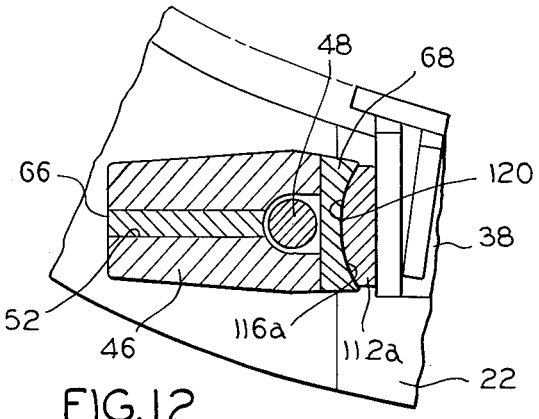
FIG. 12 is a top sectional view of another embodiment of the invention.

A further modified form of the invention is shown in FIG. 12 wherein a shim **112*a* has an arcuate convex surface 120 which is complimentary to a convex arcuate surface 116*a* formed at the front of the wedge block 68 and in an opposed relation to the edge of the bracket plate 38. The embodiment of FIG. 12 provides self-alignment between the gib block 46 and the bracket plate 38** should angularity between the two occur either as a result of manufacturing tolerances or creep caused by vessel expansion and contraction.

Figure 13:
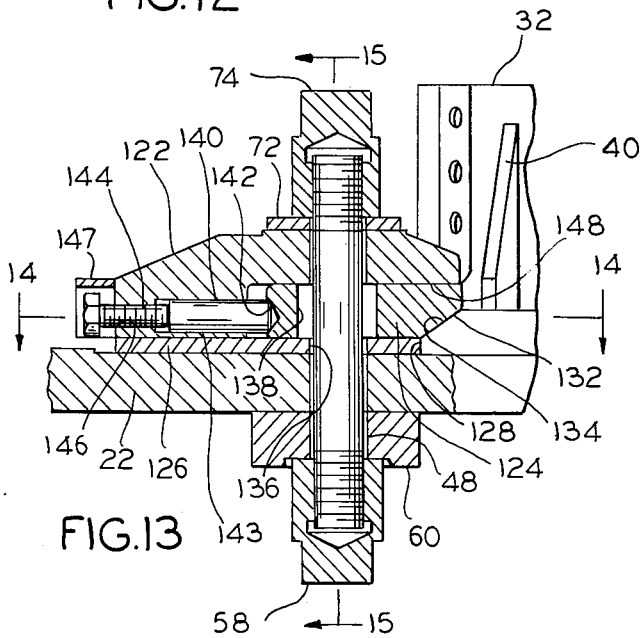
FIG. 13 is a side sectional view of yet another embodiment of the invention.
Figure 15:
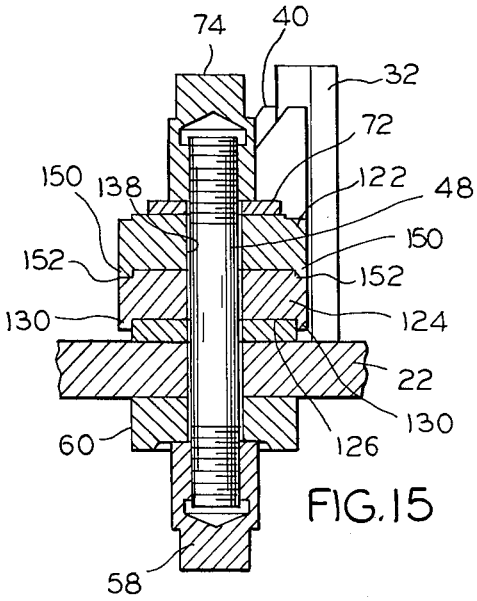
FIG. 15 is a view taken along lines 15—15 of FIG. 13.
Figure 14:
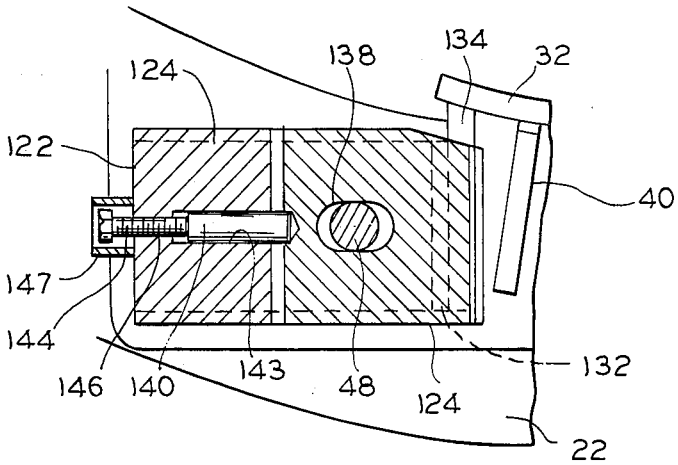
FIG. 14 is a view taken along lines 14—14 of FIG. 13.

A further embodiment of the invention is shown in FIGS. 13–15 wherein those portions which are the same as corresponding portions of the embodiment of FIGS. 3–6 have been given the identical reference numerals. More specifically, this embodiment of the invention includes a gib block 122 mounted on a pin 48 and a bracket retainer block 124 mounted for movement between gib 122 and a guide block 126.

The guide block 126 is suitably affixed to the top flange 22 and is generally flat and rectangular in plan view with its major axis generally normal to the edge surface 128 of flange plate 38. The bracket retainer block 124 is also generally rectangular in plan view and is substantially thicker and shorter than the guide block 126. In addition, retainer block 124 is slightly wider than guide block 126 and has a pair of depending flanges 130 which are parallel to and engage the sides of guide block 126. A beveled surface 132 is formed in the front end of block 124 and is complimentary to the oppositely beveled surface 134 formed in the end 128 of bracket plate 138.

The pin 48 extends through a first opening 136 in guide plate 126 and an oval opening 138 in gib block 122 whose major axis is parallel to the flanges 130 and is substantially larger than the diameter of the pin 48. Extending from the retainer block 124 and generally normal to the axis of pin 48 is a plunger rod 140. The rod 140 is suitably affixed in an opening 142 formed in block 124 and extends through a coaxial opening 143 in block 122. The remote end of pin 142 is engaged by an adjusting screw 144 which is received in a threaded opening 146 extending through gib block 122 in a coaxial relation to pin 142. A shield 147 may be affixed to the rear of block 122 and substantially surrounds the head of screw 144.

The gib block 122 is substantially coextensive in plan view with the guide plate 126 as seen in FIG. 15 except that it is substantially the same width as the clamp block 124. A recess 148 is formed in the lower front portion of gib block 122 and is substantially coextensive with the clamp block 124 which is disposed therein. A pair of depending flanges 150 are formed in the lateral sides of gib block 122 adjacent the edges of recess 148 for being received in corresponding grooves 152 formed in the edges of clamp block 124.

When the vessel which includes the embodiment of FIGS. 13–15 is to be installed, the bracket plate 38 is first positioned on the trunnion ring flange 122 between pins 148. The gib block 122 and the clamp block 124 are then lowered into position and the cap nut 74 partially tightened. The adjusting screw 144 is then rotated forcing the retainer block 124 toward the edge of bracket plate 138. When the surface 132 on retainer block 124 is approximately 1/32 of an inch from the beveled surface 134 of plate 38, the cap nut 74 is tightened to clamp the retainer block 124 in position between the gib 122 and the guide plate 126. The gap between surfaces 132 and 134 permits bracket plate 38 to move relative to the flange 22 as the vessel 10 expands and contracts.

Figure 16:
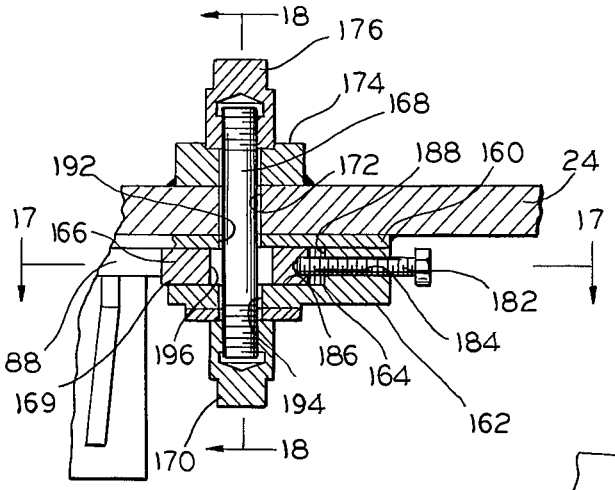
FIG. 16 is a side sectional view of an alternate embodiment of the bottom portion of the suspension assembly according to the invention.
Figure 17:
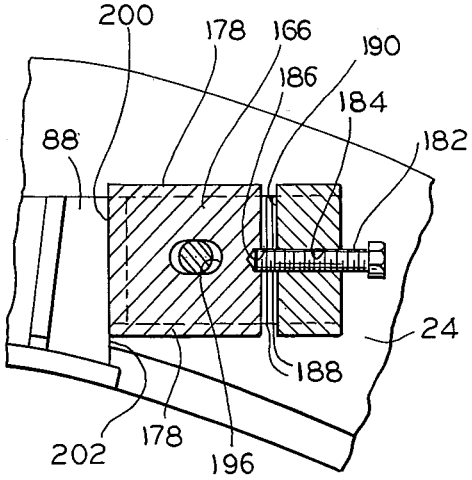
FIG. 17 is a view taken along lines 17—17 of FIG. 16.
Figure 18:
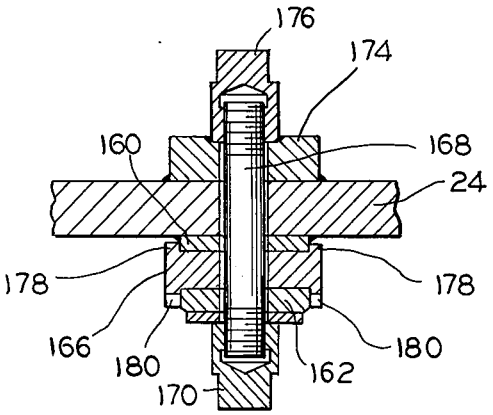
FIG. 18 is a view taken along lines 18—18 of FIG. 17.

FIGS. 16–18 illustrate an alternate embodiment of the bottom retainer assembly which may be employed with the gib block assembly shown in FIGS. 13–15. The clamp block assembly is shown in FIG. 16 to include a guide plate 160, a clamp block 162 having a recess 164 for receiving a bracket retainer block 166 and a pin 168 and cap nut 170 for clamping the retainer block 166 between the clamp block 162 and guide plate 160. The pin 168 extends through an opening 172 in trunnion ring bottom flange 24 and is retained in position by means of a block 174 and a cap nut 176 affixed to the upper surface of flange 24. The guide block 160 is generally rectangular and is oriented with its major axis generally normal to the axis of pin 168. The retainer block 166 is substantially thicker, slightly wider and substantially shorter than the guide block 160. In addition, a lip 178 extends upwardly along the edges of retainer block 166 and engages the lateral edges of guide block 160. The clamp block 162 is generally coextensive with the guide plate 160. The recess 164 is generally rectangular for receiving the clamp block 166. A second pair of lips 180 extends downwardly along the lateral edges of retainer block 166 for engaging the lateral edges of clamp block 162. Extending through a threaded opening 184 in the rear of clamp block 162 and in a direction generally normal to the axis of pin 168 is an adjusting screw 182. The end of screw 182 is received within a cylindrical recess 186 formed in the rear of retainer block 166. In addition, a plurality of generally rectangular shims 188 are disposed between retainer block 166 and the end wall 190 of recess 164 and each has an aperture to permit the passage of adjusting screw 182.

The pin 168 extends through generally circular openings 192 and 194 in the guide plate 160 and the clamp plate 162, respectively, and through an oval opening 196 and the retainer block 166. The major axis of opening 196 is generally normal to the front edge 200 and the side 202 of the retainer block 166 and the bracket plate 88, respectively.

The retainer assembly of FIGS. 16–18 is clamped in the manner similar to that discussed with respect to the embodiment of FIGS. 13–15. Specifically, after the lower bracket plate 88 is positioned adjacent trunnion ring bottom flange 24, the adjusting screw 182 is rotated until the forward edge 200 of retainer block 166 is approximately 1/32 of an inch from the edge 202 of bracket plate 88. The cap screw 170 is then tightened forcing the clamp block 162 against retainer block 166 clamping the latter in position.

While only a few embodiments of the invention have been illustrated and described, it is not intended to be limited thereby but only by the scope of the appended claims.

I claim:

1. A metallurgical vessel including:

a trunnion support at least partially surrounding said vessel, a plurality of bracket means affixed to said vessel in a spaced relation and engaging said trunnion support, each bracket means having an edge portion extending generally in a first direction away from said vessel, retainer means associated with each bracket means for limiting the movement thereof relative to said trunnion support, each said retainer means including a first means, a second means and clamping means, said first means being affixed to said trunnion support adjacent to the edge portion of its associated bracket means one of said first and second means having an elongate groove formed therein and the other having a complimentary guide portion, said second means being removably mounted on said first means, and with said guide portion disposed in said groove, said first and second means being arranged with said groove oriented in a second direction generally normal to said first direction whereby said second means is slideably mounted on said first means for movement in said second and an opposite direction toward and away from the adjacent edge portion of said bracket means, said second means also having a surface formed thereon and generally complimentary to said edge portion, at least a part of said surface being disposed vertically above said edge portion when said second means is in an operative position relative to said bracket means, said clamping means engaging said trunnion support and being adapted to engage said second means for releaseably clamping said second means to said first means to retain said second means in its operative position.

2. The vessel set forth in claim 1 wherein each of said bracket means has a first side spaced from said vessel and a pair of ends which define said edge portion, there being a pair of retainer means associated with each of said bracket means with one being disposed adjacent each end thereof.

3. The vessel set forth in claim 1 wherein said trunnion support has upper and lower surfaces, said bracket means including a first plurality of brackets affixed to said vessel and engaging the upper surface of said trunnion support and a second plurality of brackets affixed to said vessel and disposed adjacent the lower surface of said trunnion support, said retainer means being mounted on the upper surface of said trunnion support, and clamp block means disposed adjacent the opposite ends of each of said second plurality of bracket means, said clamp block means including a bracket retainer block and second clamp means for clamping said retainer block adjacent the side of its associated bracket means.

4. The vessel set forth in claim 3 wherein said second clamp means includes a first member affixed to said trunnion support, a second member, a clamp for clamping said first member to said second member, and a third member slidably mounted between said first and second members, and adjustment means for moving said third member between said first and second members and into proximity with said flange means.

5. The vessel set forth in claim 4 wherein said second clamp means includes a pin extending from the lower surface of said trunnion support and a nut mounted on said pin and movable into pressure engagement with said second member.

6. The vessel set forth in claim 1 wherein a recess is formed in said second means to define surfaces adjacent to and opposed to the adjacent edge portion of said bracket means, and disposed generally non-parallel with respect thereto, and shim means affixed to said second means and having surfaces formed thereon which are parallel to the adjacent edge surfaces of said bracket means.

7. A metallurgical vessel including:

a trunnion support at least partially surrounding said vessel, a plurality of bracket means affixed to said vessel in a spaced relation and engaging said trunnion support, each of said bracket means having a first side spaced from said vessel and a pair of ends which define edge portions, there being a pair of retainer means associated with each of said bracket means with one being disposed adjacent each end thereof, retainer means associated with each bracket means for limiting the movement thereof relative to said trunnion support, each said retainer means including a first means, a second means and clamping means, said first means being affixed to said trunnion support adjacent to the edge portion of its associated bracket means, said second means being removably mounted on said first means, a groove formed in one of said first and second means and a projection extending from the other of said first and second means and being substantially complimentary to and engaging said groove, said groove and projection being in relative sliding engagement for movement toward and away from the adjacent edge portion of said bracket means, said second means having a surface formed thereon and conforming generally to said edge portion, at least a part of said surface being disposed vertically above said edge portion when said second means is in an operative position relative to said bracket means, said clamping means engaging said trunnion support and being adapted to engage said second means for releasably clamping the same in its operative position.

8. The vessel set forth in claim 7 wherein said first means comprises a first block affixed to the upper surface of said trunnion support and said second means includes a second block slidably mounted on said first block.

9. The vessel set forth in claim 7 wherein said clamp means includes a pin affixed to said trunnion support and extending therefrom, apertures formed in said first and second blocks, and pin extending through said apertures, and nut means threadably received on said pin means for forcing said second block into engagement with said first block and for affixing the same adjacent said bracket means.

10. The vessel set forth in claim 9 wherein a recess is formed in said first block to define surfaces adjacent to and opposed to the end of said bracket means, and disposed generally non-parallel with respect thereto, and shim means affixed to said surfaces and having faces formed thereon which are parallel to the adjacent end of said bracket means.

11. The vessel set forth in claim 8 wherein said first means includes a first block affixed to said trunnion support and spaced from the end of said bracket means, said second means comprising second and third blocks, said second block having a first portion engaging said first block and a second portion spaced therefrom to define a gap therewith, said third block being disposed in the gap between said first and second blocks and being slidable with respect thereto, and adjustment means mounted on said second block and engagable with said third block for moving said third block into proximity with the adjacent end of said bracket means.

12. A trunnion support for a metallurgical vessel, a plurality of bracket means affixed to said vessel in spaced relation and engating said trunnion support, each said bracket having a pair of opposite edges extending in a first direction generally outwardly of said vessel, a pair of retainer means associated with each bracket means for limiting the movement thereof relative to said trunnion support, one of said retainer means being disposed adjacent one edge of its associated bracket means, each said retainer means including a first member, a second member and clamping means, said first member being affixed to said trunnion support adjacent to the edge of its associated bracket means, said second member being removeably mounted on said first member and having a surface formed thereon and conforming generally to the adjacent edge of said bracket means, first and second elongate guide means being formed respectively on said first and second members, said first and second guide means being complimentary to each other and extending in a second direction generally normal to said first direction for mounting said second member in sliding engagement on said first member and for movement toward and away from the adjacent edge of said bracket, one of said first and second guide means comprising a channel and the other of said first and second guide means comprising a projection extending into said channel, at least a part of said surface being disposed in proximity with said edge when said second means is in an operative position relative to said bracket means, said clamping means engaging said trunnion support and having a clamping mode for clamping the same to said first member, said clamping means having an unclamped mode permitting at least partial sliding movement of said second member on said first member and a release mode wherein said first member can be removed from said second member.

13. The trunnion set forth in claim 12 wherein said trunnion support has upper and lower surfaces, said bracket means including a first plurality of brackets affixed to said vessel and engaging the upper surface of said trunnion support and a second plurality of brackets affixed to said vessel and disposed adjacent the lower surface of said trunnion support, said retainer means being mounted on the upper surface of said trunnion support, and clamp block means disposed adjacent the opposite ends of each of said second plurality of bracket means, said clamp block means including a bracket retainer member and a clamp member for clamping said retainer member adjacent the side of its associated bracket means.

* * * * *